US005800741A

United States Patent [19]

Glenn et al.

[11] Patent Number: 5,800,741

[45] Date of Patent: *Sep. 1, 1998

[54] EVAPORATIVE HUMIDIFIER HAVING WICK FILTER WITH COLOR CHANGE INDICATOR

[75] Inventors: Neville R. Glenn, Milford, Mass.; Ted Collier, Chillicothe; Lori Rigsby, Waverly, both of Ohio

[73] Assignee: Holmes Products Corp., Milford, Mass.

[ * ] Notice: The term of this patent shall not extend beyond the expiration date of Pat. No. 5,529,726.

[21] Appl. No.: 695,408

[22] Filed: Aug. 12, 1996

Related U.S. Application Data

[63] Continuation-in-part of Ser. No. 670,345, Jun. 25, 1996, which is a continuation of Ser. No. 222,295, Apr. 4, 1994, Pat. No. 5,529,726, and a continuation-in-part of Ser. No. 31,893, Dec. 8, 1994, abandoned.

[51] Int. Cl.[6] ..... B01F 3/04

[52] U.S. Cl. ..... 261/107; 261/DIG. 41; 261/DIG. 46; 55/514

[58] Field of Search ..... 261/107, 99, 104, 261/106, DIG. 41, DIG. 46; 55/514

[56] References Cited

U.S. PATENT DOCUMENTS

| | | | |
|---|---|---|---|
| 1,646,329 | 10/1927 | Ulrich . | |
| 1,991,581 | 2/1935 | Shelor . | |
| 2,032,634 | 3/1936 | Ross . | |
| 2,092,630 | 9/1937 | Bailey . | |
| 2,187,019 | 1/1940 | DeMund et al. . | |
| 2,637,540 | 5/1953 | Rowe | 261/DIG. 41 |
| 2,827,270 | 3/1958 | Martin . | |
| 3,193,261 | 7/1965 | Nesbitt . | |
| 3,274,993 | 9/1966 | Martin . | |
| 3,321,931 | 5/1967 | Lehmkluhl . | |
| 3,497,453 | 2/1970 | Yurdin | 261/DIG. 46 |
| 3,563,828 | 2/1971 | Marshall | 55/514 |
| 3,747,773 | 7/1973 | Jackson | 55/514 |
| 3,815,341 | 6/1974 | Hamano | 55/514 |
| 3,864,437 | 2/1975 | Blaszkowski . | |
| 4,089,915 | 5/1978 | Jackson . | |
| 4,166,087 | 8/1979 | Cline et al. . | |
| 4,225,542 | 9/1980 | Wall et al. . | |
| 4,428,890 | 1/1984 | Harroll | 261/DIG. 41 |
| 4,649,000 | 3/1987 | Biesemeyer | 261/DIG. 41 |
| 4,694,142 | 9/1987 | Glucksman . | |
| 4,698,188 | 10/1987 | Gutmann . | |
| 4,752,423 | 6/1988 | Wong . | |
| 4,830,791 | 5/1989 | Muderlak et al. . | |

(List continued on next page.)

FOREIGN PATENT DOCUMENTS

| | | |
|---|---|---|
| 1261072 | 4/1961 | France . |
| 362821 | 8/1962 | Switzerland . |

OTHER PUBLICATIONS

Best Products Cataloge, pp. 44 and 1.

*Primary Examiner*—Tim R. Miles
*Attorney, Agent, or Firm*—Hoffmann & Baron, LLP

[57] ABSTRACT

An evaporative humidifier includes a base having a portion defining a reservoir for holding a quantity of water. A housing is mounted on the base over the reservoir, the housing having an air inlet and an air outlet. A cylindrically shaped wick filter with a permeable support is seated in the reservoir and extends up into the housing. The cylindrically shaped wick with permeable support filter has an open top end and a sidewall. A color change indicator strip is provided on the inner portion of the sidewall. The color change indicator strip provides a signal when the filter requires changing due to the extent of use and immersion of the filter in water. A fan is mounted inside the housing for drawing air into the housing through the air inlet, then into the center of the cylindrically shaped wick filter through the open top end, then out through the sidewall of the cylindrically shaped wick filter with a permeable support and then out of the housing through the air outlet. A heater is also mounted inside the housing for heating the air drawn into the housing prior to passage through the cylindrically shaped wick filter with a permeable support.

23 Claims, 7 Drawing Sheets

U.S. PATENT DOCUMENTS

| | | | |
|---|---|---|---|
| 4,839,014 | 6/1989 | Park et al. . | |
| 5,014,338 | 5/1991 | Glucksman . | |
| 5,037,583 | 8/1991 | Hand . | |
| 5,037,586 | 8/1991 | Mehrholz et al. . | |
| 5,077,187 | 12/1991 | Factor et al. . | |
| 5,122,428 | 6/1992 | Simons . | |
| 5,143,655 | 9/1992 | Chiu et al. . | |
| 5,374,381 | 12/1994 | Schuld et al. | 261/DIG. 41 |
| 5,529,726 | 6/1996 | Glenn | 261/142 |
| 5,578,113 | 11/1996 | Glenn | 261/107 |

EVAPORATIVE HUMIDIFIER HAVING WICK FILTER WITH COLOR CHANGE INDICATOR

CROSS REFERENCE TO RELATED APPLICATIONS

This is a continuation-in-part of U.S. patent application Ser. No. 08/670,345 filed on Jun. 25, 1996 which is a continuation of U.S. patent application Ser. No. 08/222,295 filed on Apr. 4, 1994 and issued as U.S. Pat. No. 5,529,726 on Jun. 25, 1996; and a Continuation-in-Part U.S. Design patent application Ser. No. 29/031,893 filed on Dec. 8, 1994, now abandoned.

BACKGROUND OF THE INVENTION

The present invention relates generally to humidifiers and more particularly to evaporative humidifiers utilizing a wick filter. This invention is further directed to a wick filter for use with an evaporative humidifier with a color change indicator that shows when the filter should be changed.

Humidifiers have been found to be very useful in raising the humidity of air present inside homes, particularly during periods of very dry weather or in winter, when outside air of low temperature is drawn inside a home and heated, causing the relative humidity within the home to be lowered to an uncomfortable level. Under these circumstances it is beneficial to introduce moisture into the air. Several types of humidifiers, used for increasing humidity in a room or enclosure are well-known in the art. Examples of these include steam-type humidifiers, ultrasonic humidifiers, warm-air humidifiers and evaporative humidifiers.

Direct evaporative humidification may be accomplished by heating a reservoir of water to accelerate the vaporization rate, i.e. placing a pan containing water on a radiator. Alternatively, steam-type humidifiers generally include a water container and an electric heating element submerged in the water, there being provided safety devices for switching off the current as soon as the water level drops below the heating element. A flow of hot steam is blown directly into the room to be humidified.

Ultrasonic humidifiers generally have a container filled with water which is brought to vibration by high-frequency vibrator that causes the water to be atomized. An air stream directed onto the water surface carries the mist into the room to be humidified.

Warm-air humidifiers are similar to steam-type humidifiers in that water is heated to the boiling point. However, the steam generated by warm-air humidifiers is carried into a room as a mist mixed with air, at a temperature to be selected by judiciously choosing the ratio of steam to air.

Humidification may also be achieved by forcing air through a medium laden with water. It is known that the rate of vaporization is a function of the temperature of the water and the surface area exposed to the circulating air. Accordingly, evaporative humidifiers generally include an open vessel containing a reservoir of cold water, a porous medium structure partly submerged in the cold water and a blower unit for drawing air through the porous medium structure. The porous medium is typically either (1) in the shape of a disc or a drum with part of the medium dipping into the water, the disc or drum being slowly rotated while air is blown through the portion above the water level, thus carrying humidity into the room; or (2) in the form of a stationary body adapted to draw water into the upper non-immersed part by capillary action, such as in the case of a wicking filter, the water on the upper non-immersed portion of the stationary body being discharged into the room by air blown therethrough.

There are different approaches to increasing the surface area of the water exposed to the air. The first is to increase a substantially two dimensional wicking surface by extending the length of the surface area being exposed to the blown air; the second is to provide a three dimensional wick with an increased thickness. The typical means of extending length is to use a continuous belt pad which alternately dips into a reservoir and then moves in the path of fan blown air.

Another approach for providing greater wick area by increased thickness is to devise a medium which by capillary action draws water out of the reservoir and into the path of moving air. The advantage of a wick type filter is that it becomes less efficient as the moisture level in the room air increases. This means that the system is self-limiting and does not overly humidify a space like other systems, such as the steam vaporizers and spray vaporizers.

There are, however, some problems associated with wick humidifier filters. They tend to accumulate minerals from the water that block capillary action. It is difficult to determine when a wick filter is spent and must be changed. Also, wick filters tend to sag when loaded with water, collapsing the wick structure and inhibiting air flow. Further, in some wick filters it is difficult to maintain the permeability of the wick material employed to present sufficient moisture to a path of air flow.

Accordingly, it is desirable to provide for a new and improved wick filter for use with an evaporative humidifier, in which moisture is added to the intake air in a controlled manner. It is also desirable to provide a wick filter which indicates when it requires changing due to use.

U.S. Pat. No. 4,225,542, to Wall et al. which issued Sep. 30, 1980, discloses an evaporative humidifier with a humidification chamber of about 200 cc internal volume having an inlet connection port and an exit connection port for gases, a liquid reservoir and a removable porous evaporative element of open-ended cylindrical design which fits loosely within the humidification chamber when dry but which swells into good thermal contact with the side walls of the chamber when wet and which extends into the liquid reservoir. The chamber is tightly surrounded by a heating element so that heat is transferred directly to the chamber walls adjacent to the porous removable evaporative element and not to the liquid reservoir. The heating element is preferentially equipped with suitable electronic controls to monitor the heat transfer surface temperature, and to shut the unit off when said temperature exceeds a predetermined level. The humidifier is designed so that the gases reaching the patient will be at 100% relative humidity under most conditions of gas flow and heater temperature settings.

U.S. Pat. No. 4,752,423, to Wong, which issued Jun. 21, 1988, describes a combined humidifier and fan heater unit which includes a humidifier part electrically operable to dispense water vapor into the surrounding air space for humidifying purposes, and a fan heater part electrically operable either together with or instead of the humidifier part to draw air from the surrounding air space, through heating means, by which it is raised in temperature or not as desired, and passed back into the surrounding air space.

U.S. Pat. No. 4,089,915, to Jackson, which issued May 16, 1978, describes a self-sterilizing humidifier for air to be breathed, the humidifier being of the type having an endless porous media driven to be progressively immersed in a receptacle. Means are shown for periodically providing throughout the effective volume of water in the receptacle heated water at a temperature above about 180° F., while the media drive is actuated, the heated water being sufficient to progressively expose the media to bacteria-killing conditions. In one embodiment a heater chamber automatically discharges a charge of water heated above about 180° F. into the receptacle. In one such case a thermal actuator has sensitive parts exposed to water in both the heater chamber and the receptacle, the actuator releasing the charge when water in the receptacle lies below its sensitive part, and water in the heater chamber has reached or exceeds the selected high temperature. In another embodiment the heater element is in the receptacle and is periodically energized to maintain bacteria-killing conditions while the blower in the air flow path is de-energized to reduce evaporative cooling of the media and water during the sterilization interval.

U.S. Pat. No. 5,037,586, to Mehrholz et al., which issued Aug. 6, 1991, describes a humidifier which can be mounted in limited and a variety of different shaped spaces in a building such as a condominium or apartment, the humidifier comprising a centrifugal blower driven by an adjustable speed motor mounted in a cube-shaped module so that an outlet from the blower can be mounted on any selected side of the module such as any of the sidewalls or the top or bottom. A humidifier unit is selectively connectable to the centrifugal blower cube-shaped module and a preheater can be connected to the input of the humidifier. A water supply and drain can be connected to the humidifier and the output of the blower may be connected to the heat ducts to distribute the humidified air. Means are provided for mixing ambient air into the input of the blower, if desired. A drain safety switch may be provided to turn off the unit if the drain becomes clogged and also to remove excess water from the collecting pan. The unit may be connected to a remote digital electronic sensor humidistat having single or multiple stages or may include an integral humidistat in the unit.

U.S. Pat. No. 3,193,261, to Nesbitt, which issued Jul. 6, 1965, describes a humidifier designed to deliver air cleansed of air-borne particles, free of large water droplets and containing a maximum amount of moisture, the humidifier comprising a housing provided with relatively spaced air inlet and outlet openings that are separated by a baffle member which obstructs the direct flow of air from the air inlet opening to the air outlet opening. In passing through the humidifier, the circulated air, because of the baffle member and the relative positioning of the air inlet and outlet openings, is made to undergo a marked change in direction prior to being discharged from the humidifier. Atomizing means is also provided within the humidifier and is so positioned in the air stream as to generate a water vapor cloud upstream of the point at which the circulated air must undergo the marked change in direction. An air flow pattern is thus defined whereby air is drawn in through the air inlet opening, directed through the water vapor cloud to pick up moisture, undergoes a marked change in direction and then passes through the outlet opening. The larger water droplets and air borne particles, being relative heavy, resist the change in direction and are separated from the main air stream, so that the air, which is discharged from the outlet opening, contains moisture in only the most finely divided form and is cleansed of substantially all foreign particles. To insure the addition of a maximum amount of moisture to the air, the atomizing means also includes a heating element. The heating element, in addition to contributing to the formation of the water vapor cloud, increases the temperature of the air to be treated and correspondingly increases its moisture carrying capacity.

U.S. Pat. No. 5,014,338, to Glucksman, which issued May 7, 1991, describes a portable warm-air humidifier, the components of which are enclosed in a housing. The components include an evaporation chamber in the shape of an inverted cup which has a steam outlet in its top and contains an electric heating element positioned at a short distance above its open bottom. The chamber bottom and the heating elements are immersed in water contained in the main compartment of an open, removable tray, having a smaller filling compartment communicating with the main compartment. The tray may be removed from the housing for cleaning. The neck of an inverted, removable jug filled with water is placed into the filling compartment, and water fills the tray until its level reaches the lower rim of the jug's neck. A blower is mounted above the evaporation chamber and delivers cool air through a duct which communicates with the evaporation chamber via its steam outlet, and humidified air is blown back into the room. The humidifier also contains a control element to prevent damage to the heating element and signal lamps warning an attendant to refill the jug with water. The humidifier may also include a removable drawer.

U.S. Pat. No. 4,698,188 to Gutmann, which issued Oct. 6, 1987, describes a humidifier comprising a housing having an upper and lower part. The upper part includes a fan assembly and the lower part forms a water chamber. The humidifier further includes an intermediate part located within the housing. The intermediate part is slidable within the housing and floats on the water surface. The intermediate part includes an air permeable and water absorbing mat. The lower portion of the mat is in contact with the water which is drawn up the sides of the mat by capillary action. A stream of air generated by the fan evaporates the water from the mat dispersing it to the surrounding environment. As the water is evaporated, the reservoir level drops and the entire intermediate part moves downwardly with the falling water level. Therefore, the lower part of the evaporative mat is always submerged in the water to the same depth so that the capillary action of the evaporative mat remain constant independent of the water level.

U.S. Pat. No. 3,864,437 to Blaszkowski, which issued Feb. 4, 1975, describes a humidifier having a water receptacle that is vertically expandable and collapsible. It is provided with a float at its upper end connected to the side wall of the receptacle. A humidifying means comprises a water absorbing, air permeable annular wall and/or a water slinger driven by an air impeller. Rotating fan blades of a fan assembly draw air into the water absorbing angular wall causing the air to absorb moisture, which is then directed back into the room. The water absorbing annular wall and the fan assembly are supported on the float, and as the water level recedes the whole assembly descends, so that the lower end of the wall always remains immersed in the water.

French Patent No. 1,261,072 to Schiesser, FIGS. 1 and 2 show a humidifier having a centrally located fan assembly surrounded by an annular water reservoir. A cylindrically shaped water absorbing wicking means is disposed within the reservoir adjacent to the outside diameter wall. A portion of the wicking means is submerged in the water and through capillary action the entire wick becomes water saturated. As an air stream, generated by the fan, flows over the wick, the air becomes humidified and is expelled to the outside surrounding environment.

None of the prior art, however, provides a wick filter for an evaporative humidifier which solves the problems of mineral loading, permeability of the wick material, sagging and collapse of the wick filter, as described above. In addition, none of the prior art provides a wick filter which indicates when it must be changed due to use.

Accordingly, it is a goal of this invention to provide a new and improved evaporative humidifier in which moisture is added to the intake air in a controlled manner for greater effectiveness and for sustained operation, and in which the intake air is filtered.

It is another goal of this invention to provide an evaporative humidifier having a wick filter, in which the intake air is heated before moisture is added for even greater effectiveness and increased efficiency during sustained operation, while improving the filtering of incoming air.

It is also a purpose of this invention to provide an evaporative humidifier which includes a new and improved flow path of air into, through and out of the unit.

It is a further purpose of this invention to provide an evaporative humidifier having a wick filter with a permeable support structure that will not sag or collapse.

It is a further goal of the present invention to provide an evaporative humidifier with a wick filter which presents a maximum surface area in the least amount of space.

It is still a further purpose of the present invention to provide a wick filter for an evaporative humidifier which indicates when the filter is spent and should be replaced.

SUMMARY OF THE INVENTION

These and other goals and purposes are satisfied by an evaporative humidifier constructed according to one feature of this invention, which includes a base that includes a portion defining a reservoir for holding water, a housing mounted on the base over the reservoir, the housing having an air inlet and an air outlet. A cylindrically shaped wick filter having a permeable support is seated in the reservoir and extends into the housing. The cylindrically shaped wick filter with its permeable support has an open end and a sidewall. A fan inside the housing draws air into the housing through the air inlet and into the center of the cylindrically shaped wick filter and permeable support, through its open end. The air is driven out through the sidewall of the cylindrically shaped wick filter and support structure and out of the housing through the air outlet.

An evaporative humidifier constructed according to another feature of this invention comprises a base including a portion defining a reservoir for holding water. A housing is mounted on the base over the reservoir. The housing has an air inlet and an air outlet, a cylindrically shaped wick filter with a permeable support is seated in the reservoir and extends into the housing. The cylindrically shaped wick filter and support has an open end and a sidewall. A fan located inside the housing draws air into the housing through the air inlet, and into the center of the cylindrically shaped wick filter and permeable support through its open end. The air is then forced out through the sidewall of the cylindrically shaped wick filter and out of the housing through the air outlet. A heater inside the housing heats the air drawn into the housing prior to passage through the cylindrically shaped wick filter and permeable support.

Another aspect of the present invention takes full advantage of current wick technology while solving the above-mentioned technical limitations, by providing a permeable support structure for the wick filter which is integral with the filter media. In this manner the wick filter will not sag and therefore restrict capillary flow and provide non-restricted air flow through air passages even when saturated with water and/or when accumulated minerals weight the wick filter down. In addition, the shape of the support structure and the wick filter is cylindrical, rather than the conventional vertical block configuration, thus, providing greater surface area in a smaller space. An expanded aluminum support frame bonded to the outer cylindrical surface of the wick filter prevents sagging of the wick filter and keeps the wick filter open even when fully saturated with water.

In a preferred embodiment of the present invention, the wick filter has an indicator, preferably a painted strip, which changes color based upon the length of time the wick filter has been in use and saturated with water. The dyes that are used to make the indicator strip are preferably Acid Blue dye which is very slightly soluble in water and Direct Red dye which is practically insoluble in water. Preferential solubility and diffusion of the one dye due to higher water solubility causes the color change of the indicator strip after prolonged immersion time of the wick filter in water. Changing the spent wick filter with permeable support for a fresh one, results in a combined effect, allowing the filter to work and trap minerals and sediment found in the water while maintaining its shape to ensure an output of clean moist air.

For a better understanding of the present invention, reference is made to the following description, in conjunction with the accompanying figures, the scope of which is pointed out in the appended claims.

BRIEF DESCRIPTION OF THE DRAWINGS

In the drawings like reference numerals represent like parts.

DETAILED DESCRIPTION OF PREFERRED EMBODIMENTS

Figure 1:
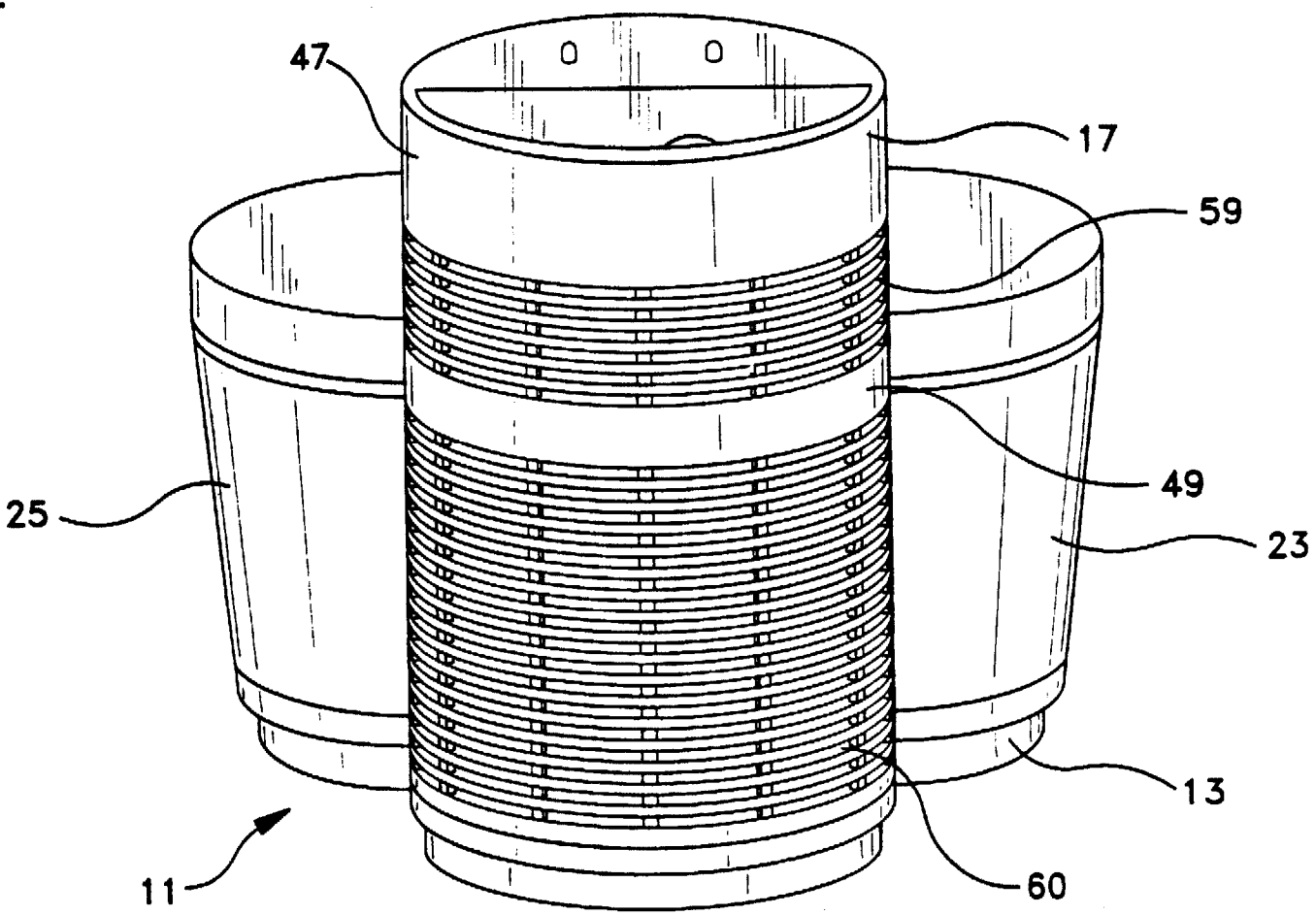
FIG. 1 is a perspective view of an evaporative humidifier constructed according to the teachings of this invention.

The present invention is directed to an evaporative humidifier in which the air is heated before it is passed through a wick filter having a permeable support and a color indicator strip; and, in which the air enters and exits the unit from the side.

Referring now to the drawings, there is shown an evaporative humidifier constructed according to this invention and identified by reference numeral 11.

For simplicity, attaching hardware such as nuts and bolts and other parts not pertinent to the invention are not shown.

Figure 2:
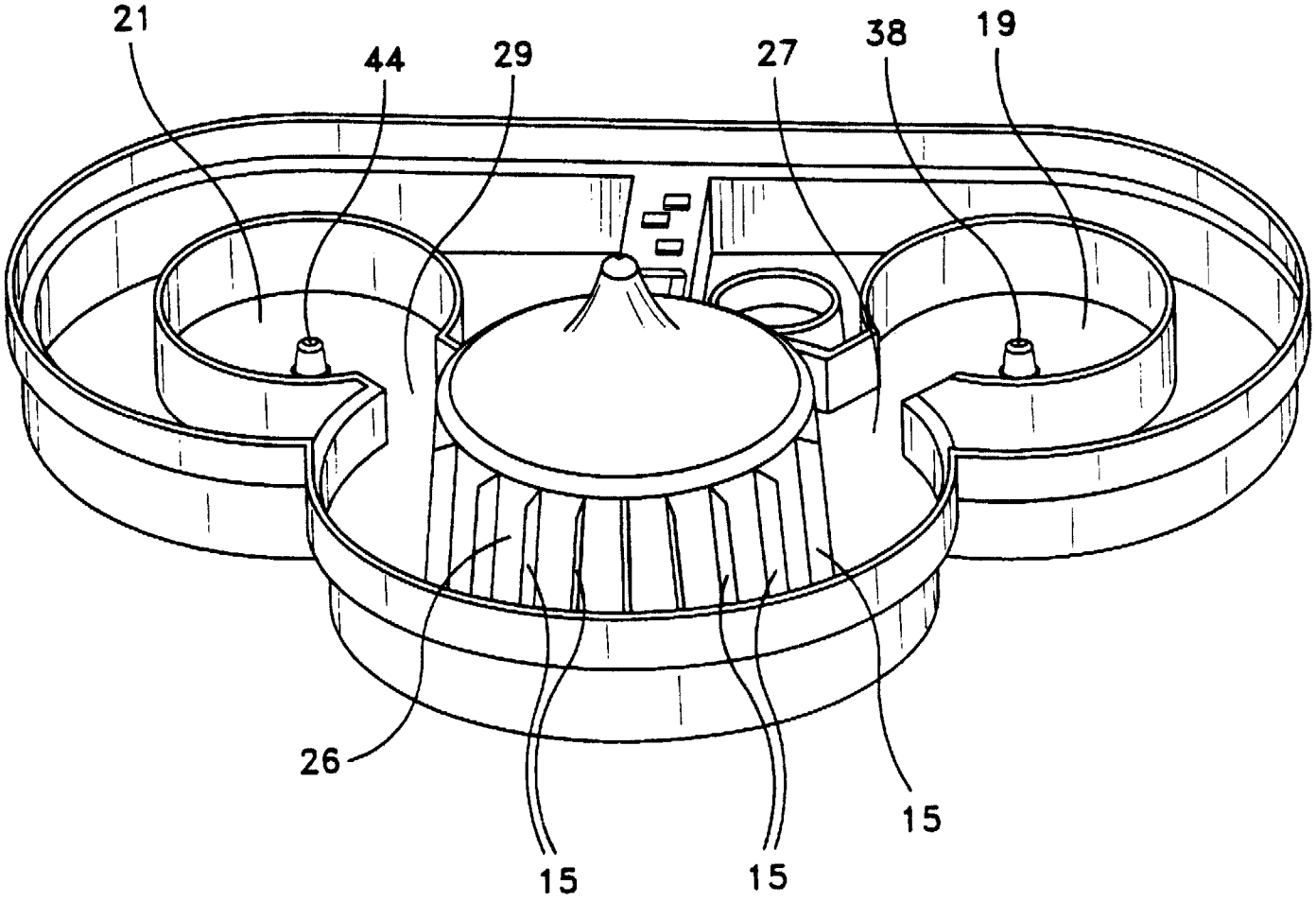
FIG. 2 is a perspective view of the base shown in the evaporative humidifier in FIG. 1.

The evaporative humidifier 11, illustrated in FIG. 1, includes a base 13 having a central portion shaped to define a reservoir 15 for removably receiving a housing 17 in which humidification takes place. Base 13, shown in FIG. 2, also includes a pair of end portions shaped to define enclosures 19 and 21 for removably receiving water supply tanks 23 and 25 for holding a supply of water to be used in the humidification process. Reservoir 15 includes an upwardly extending hub 26. Enclosure 19 has an opening 27 leading into reservoir 15 and enclosure 21 has an opening 29 leading into reservoir 15.

Figure 5:
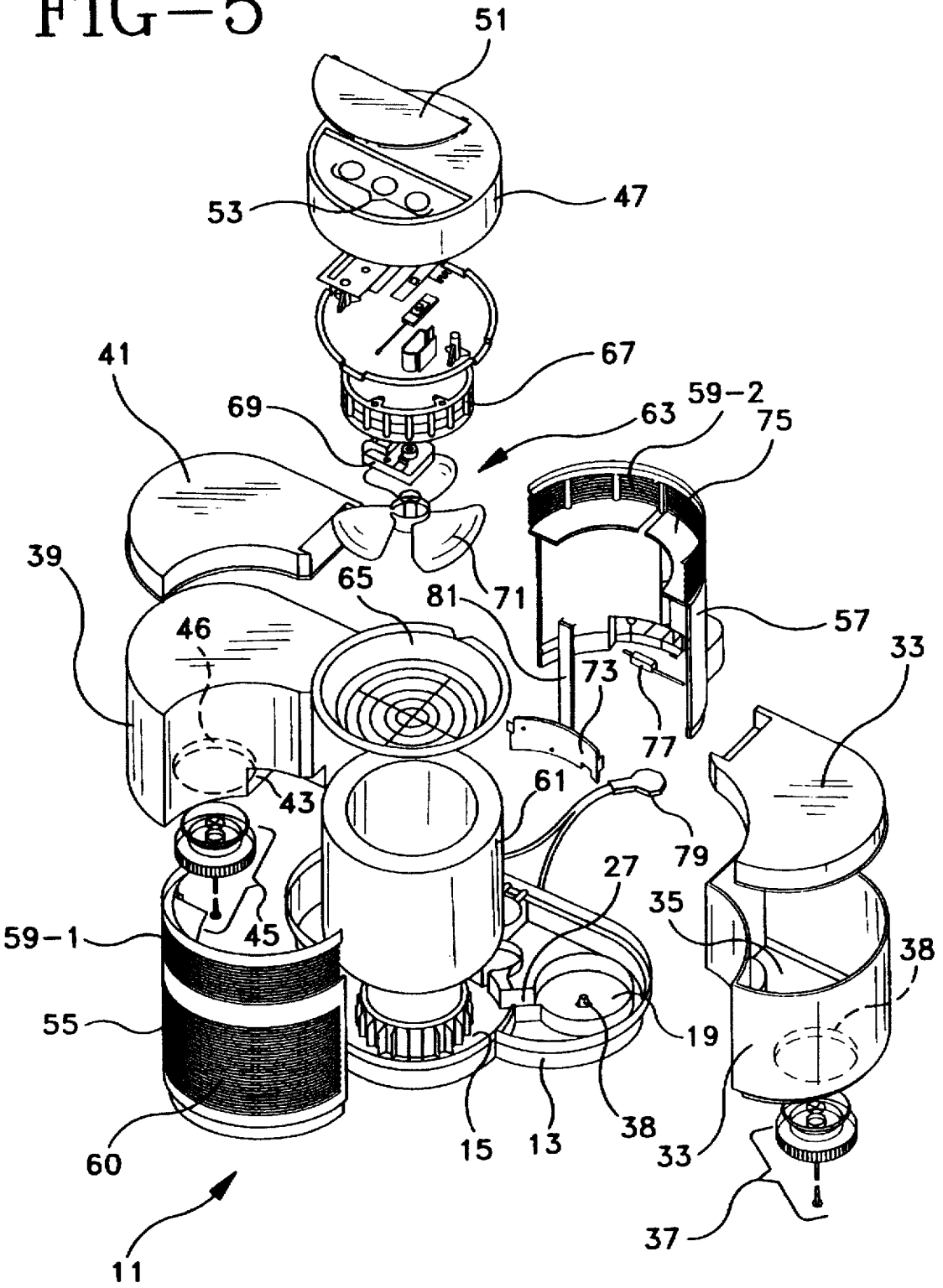
FIG. 5 is an exploded view of the evaporative humidifier shown in FIG. 1.
Figure 6:
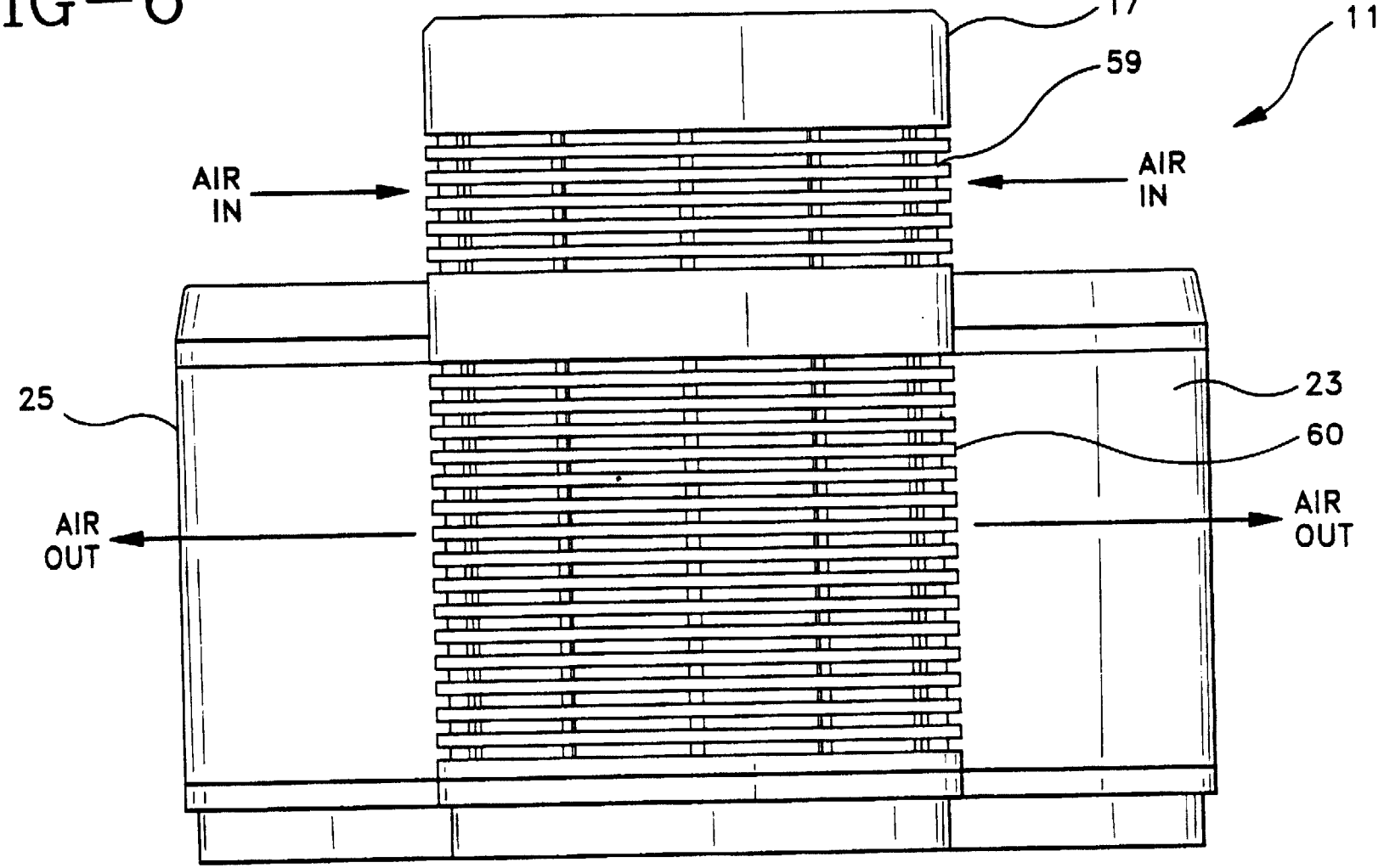
FIG. 6 is a front view of the evaporative humidifier shown in FIG. 1.

As illustrated in FIG. 5, water supply tank 23 includes a sidewall 31, a top 33 and a bottom 35. A valve assembly 37 is removably mounted in an opening 38 in bottom 35, opening 38 serving as both a filling port and an exiting port. Valve assembly 37 is positioned to engage a valve opening protrusion 38 in enclosure 19 on base 13. Water supply tank 25 includes a sidewall 39, a top 41 and a bottom 43. A valve assembly 45 is removably mounted in an opening 46 in bottom 43 and in positioned to engage a valve opening protrusion 44 in enclosure 21 on base 13. Opening 46 also serves as a filling port and an exiting port.

As shown in the figures, housing 17 is generally cylindrically shaped and includes a top 47, a sidewall 49 and an open bottom. Top 47 includes a lid 51 that can be pivotally opened to access a control panel 53 having switches 54 for controlling the operation of evaporative humidifier 11. Sidewall 49 is made up of a font section 55 and a rear section 57, the two sections being attached to each other by screws (not shown). The top portion of sidewall 49 is shaped to form an air inlet grille 59, the front part 59-1 of inlet grille 59 being on front section 55 and the rear part 59-2 of inlet grille being on rear section 57. The bottom portion of front section 55 is shaped to define an air outlet grille 60.

Evaporative humidifier 11 further includes a wick filter 61 with permeable support 61A. The wick filter 61, the evaporative humidifier 11 also includes a fan 63, an air deflector 65, and a heater 67.

Figure 7:
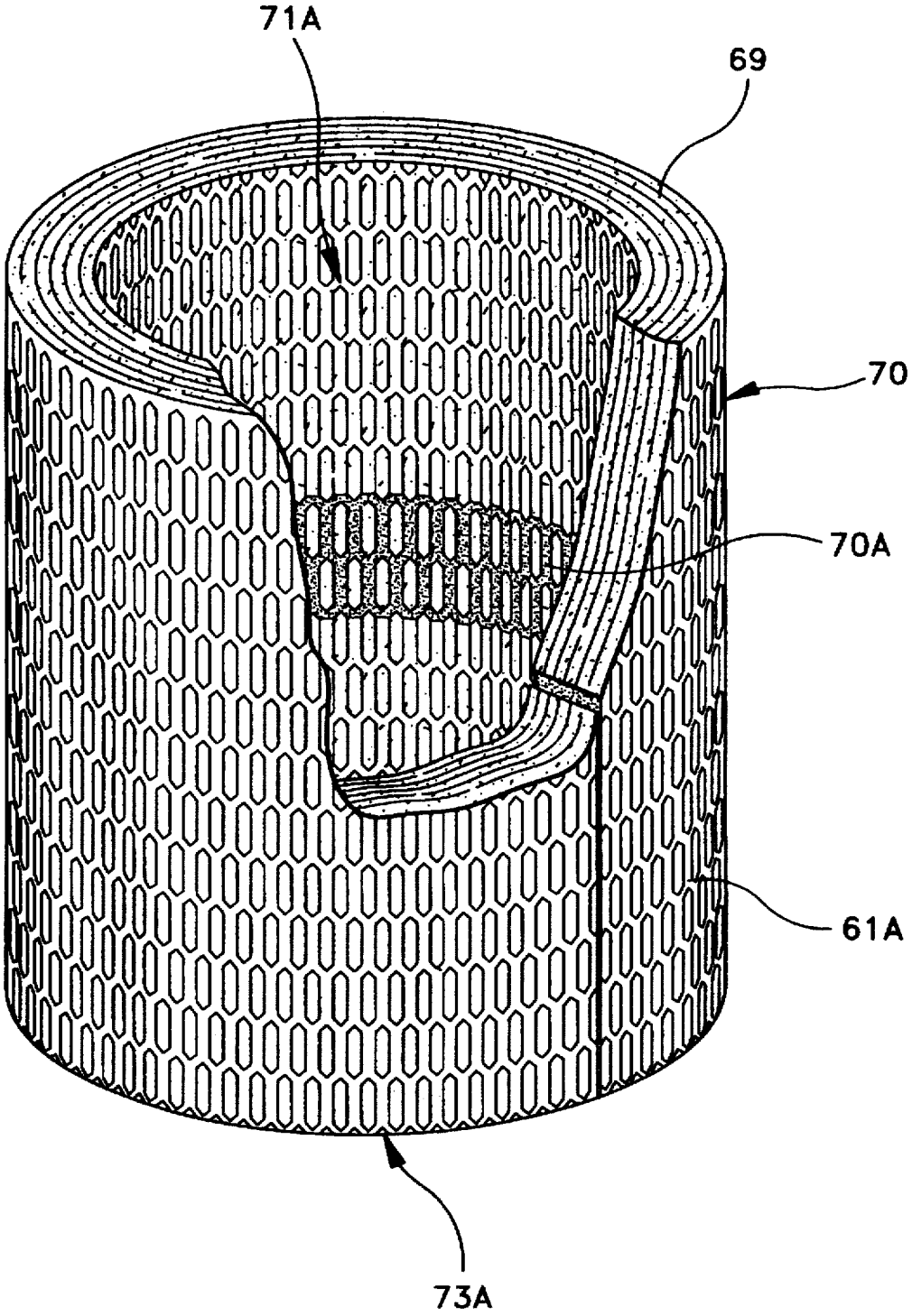
FIG. 7 is a perspective view of the wick filter and permeable support of the present invention, with a portion cut away to show the internal structure, as well as the color-change indicator strip on the inside surface of the wick filter.

The wick and filter 61 and permeable support 61A, as illustrated in FIG. 7, is preferably cylindrically shaped and includes a sidewall 69, an open top 71A and an open bottom 73A. Wick filter 61 is removably seated in reservoir 15 and extends up vertically into housing 17. Ribs 75 extending radially out from hub 26 in reservoir 15 serve to hold wick filter 61 in its cylindrical shape. The preferred permeable support 61A extends around the outer cylindrical sidewall 69 of the wick filter 61. The permeable support is preferably comprised of an expended mesh of solid material, preferably expanded aluminum. The wick filter 61 is preferably constituted of expanded cotton/ cellulose material, such as that manufactured by Columbus Industries. The wick filter is preferably impregnated with an algicide to prevent the growth of water borne organisms and increase the useful life of the filter.

In the preferred embodiment of the present invention, the wick filter has an indicator has an indicator strip 70A, which changes color based upon the length of time the wick filter has been in use and saturated with water. The wick filter is preferably made from cotton cellulose paper containing an algicide. At least two dyes are used to create the color change. In this example, the dyes used to make the indicator strip are Acid Blue 83 (C.I. 42660) and Direct Red 23 (C.I. 29160). The red dye is substantive to the cellulose, while the blue dye is not. After a prolonged immersion time of the wick filter, the water carries the blue dye from the color strip by solution and diffusion, leaving the red dye still in place since it is attached to the cellulose of the wick filter.

A fan 63 is located above the wick filter 61 and permeable support 61A in axial alignment therewith and serves to draw air into housing 17 through air inlet grille 59, move the air drawn into housing 17 along a flow path to be described below where it is heated and picks up moisture and then exhausts the air from housing 17 through outlet grille 60. Fan 63 includes a motor 69 and a set of blades 71.

Air deflector 65, which is generally circular disk shaped, is removably seated on the top of wick filter 61, above open end 71A, and serves to deflect the air drawn in by fan 63 so that it all travels down into the center of wick filter 61 and permeable support 61A.

Heater 67 is a cylindrical cage shaped resistance heater and serves to heat the air drawn in through inlet grille 59. An example of a cylindrical cage shaped resistance heater may be found in U.S. Pat. No. 4,694,142 to Dov Z. Glucksman. Heater 67 is positioned above fan blades 71 in axial alignment with wick filter 61 and permeable support 61 A. Fan 63 and heater 67 are fixedly attached to a mount 73 which is mounted on an internal flange 75 on housing 17.

The evaporative humidifier also includes a float switch 77 for turning off the unit when the water in reservoir 13 is below a certain level and a power plug 79. Switch 77 is attached to housing 17 by a bracket 81.

Figure 3:
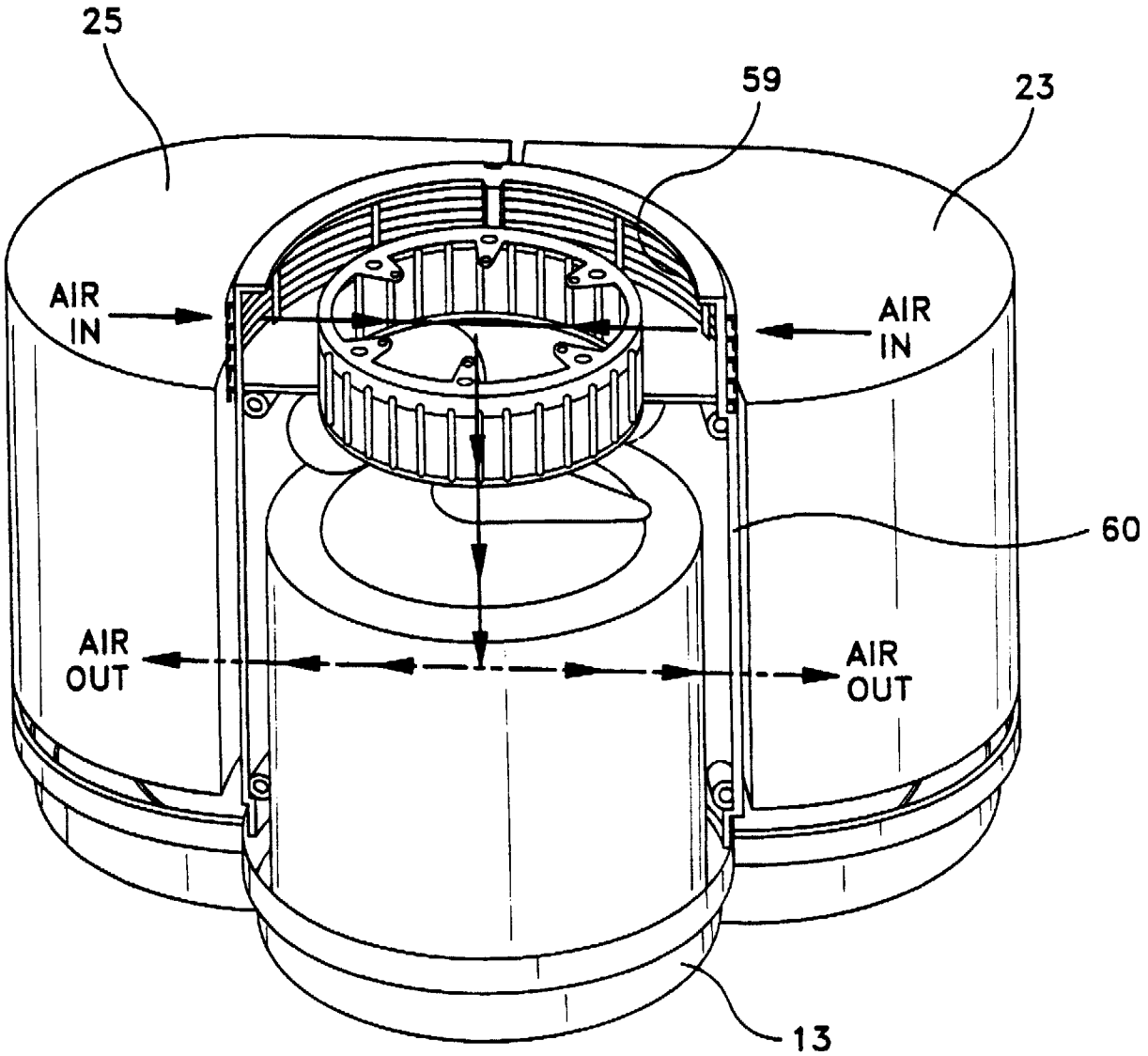
FIG. 3 is a perspective view of the evaporative humidifier shown in FIG. 1, with the top cover and front portion of the housing removed along with all components contained therein, except for the wick filter and permeable support, the fan blades and the heater.
Figure 4:
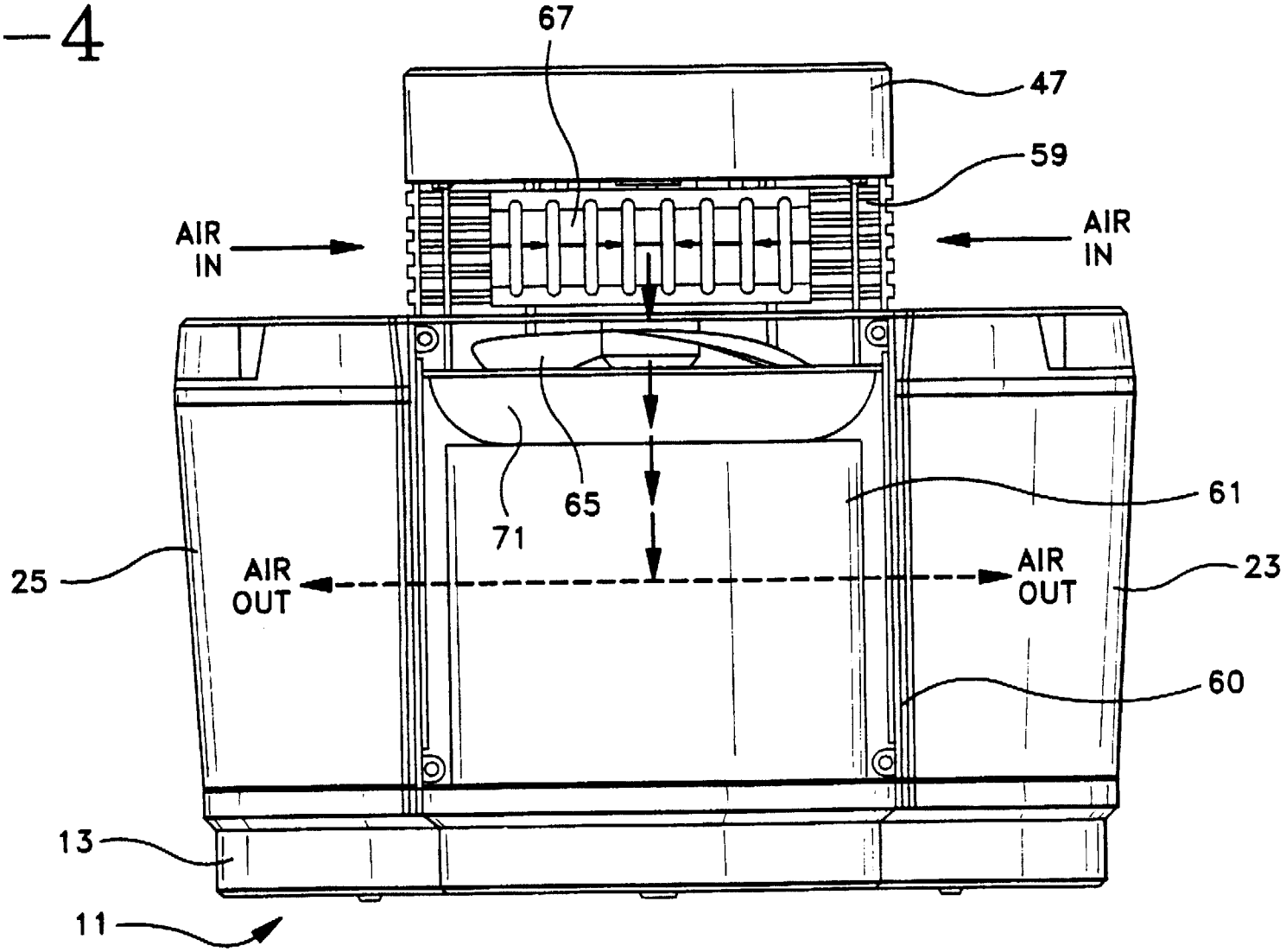
FIG. 4 is a front view of the evaporative humidifier shown in FIG. 1, with the front portion of the housing removed along with all components contained therein except for the wick filter and permeable support, the air deflector, the fan and the heater.

In the operation of evaporative humidifier 11, water from water supply tanks 23 and 25 moves from enclosures 19 and 21 into reservoir 15 and then by capillary action up into the non-immersed portion of wick filter 61. Air is drawn in through inlet 59 by fan 63, passes through heater 67 where it is heated, passes down into the center of the wick filter 61 and permeable support filter 61A, from the top end 71, and passes laterally out through the sidewall of 69 of wick filter 61 and permeable support 61A, where it picks up moisture and then exits through outlet grille 60. The flow path is shown by arrows in FIGS. 3 and 4.

The wick filter is purchased manufactured in large blocks of expanded cotton/cellulose, with a layer of expanded metal for support, by Columbus Industries, preferably having a thickness and cut size of:

| | | |
|---|---|---|
| HWF 62 | 1⅛" | 4⅛" × 19⅝" |
| HWF 64 | 1" | 6¼" × 19⅝" |
| HWF 65 | 1" | 7¹¹⁄₁₆" × 21⅞" |
| HWF 75 | 1⅛" | 7½"× 28" |

The wicks are cut into a rectangular shape having one of the preferred dimensions, and the color change dye indicator is applied to the inside surface 70, as illustrated in FIG. 7, as follows:

Mixing & Application

The first step in the manufacture of the color change indicator dye is the mixing of the dye components. The dye components are Acid Blue #83 (C.I. #42660) and Direct Red #23 (C.I. #29160). The dyes are common and are available from a number of manufacturers under the C.I. designation, in sufficient quality and quantity to perform the indicated task adequately.

The preferred dye concentration is determined by spectrophotometric transmittance readings. The preferred dye concentrations are approximately 0.125% by weight when the Acid Blue 83 dye has a transmittance of approximately 16% at a wavelength of 585 nanometers in a dilute solution of 0.00002 g/ml and also 0.125% by weight for the Direct Red 23 dye when the percent transmittance is approximately 29% at a wavelength of 507 nanometers in a dilute solution of 0.00002 g/ml. In order to properly mix the dye combination, the blue and red dyes must then be thoroughly dissolved separately in tap water at a temperature of approximately 120 degree F. Then equal quantities of the solutions are combined by vigorous agitation for about two minutes. The maximum practical upper limit concentration of the Acid Blue 83 is determined by aesthetics. The maximum practical upper limit concentration of the Direct Red 23 is determined by the saturation of the substrate.

The quantity of dye mixed, utilizing this dye combination, should be in an amount which allows complete consumption in no more than 12 hours. Storage longer than this results in an undesirable third color.

Once the precut wicks exit the manufacturing equipment, they are transferred via a simple conveyor. Stock guides are used to center the wick and to set the wick up for the dye application. The dye is preferably applied to the wick at about 0.12 ml per linear inch of wick by spraying via spray nozzle and pressure pot methodology. The spray nozzle is turned off using reflective leading and trailing edge sensors, and a latching timer. An overspray collection hood and filter bank are utilized to prevent equipment and area contamination.

Once the wick filters have been dried, the filters are then rolled and bonded with adhesive to form the required cylindrical shape.

Theory of Operation

The theory of operation of the color change in this case requires color separation based upon the differential substantivity of the dyes relative to the substrate in this case, cellulose. The Direct Red 23 is substantive to the cellulose. That is, it has a strong affinity for the cellulose and effectively dyes it directly. The Acid Blue 83 is not substantive to the cellulose, and is essentially washed out of it. This difference in the action of the two dyes allows for a color separation when the wick filter is placed in use.

When the dyes are mixed and applied to the wick filter a color of mauve to purple results. During the use of the humidifier, when the dye is exposed to water via the wick, trace amounts of the Acid Blue dye are dissolved, with little to no effect on the Direct Red. Over a period of time, 3 weeks at 24 hours of exposure to water per day, the Acid Blue dye will be displaced leaving the Direct Red, hence the operation of the indicator dye over a predetermined timeframe of use. In actual use, which is estimated as being 12 hours of operation per day, the color change indicator allows for a useful life of the wick filter of about 6 weeks.

There are several factors that will affect the useful life indicated by the dye. The most significant would be the local water pH. Deviation by 1 point either acidic or basic will greatly accelerate the disassociation of the Acid Blue rendering the indicator ineffective in approximately 2 weeks or less. Local water supply officials, however, typically attempt to prevent this large a fluctuation, however, such fluctuations are possible. Untreated earth well water pH should also be considered to be area dependent.

It also appears that it is important that the humidifier tank be kept clean, as extreme amounts of calcium deposits will alter the water pH and hence effect the indicator life. While one type of color usage indicator has been illustrated as the preferred embodiment, it is contemplated that other dyes having differential solubilities, or which differentially degrade when exposed to water, may also be effective in providing a color change signal over a predetermined period of use and thereby signal that it is time to change the filter.

The embodiment shown of the present invention is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A filter for use with an evaporative humidifier comprising:

a filter made of a water absorbant material, and a color change indicator on a surface of said filter for providing indication when said filter should be replaced.

2. The filter as recited in claim 1, wherein said color change indicator is in the form of a painted strip on an inner surface of said filter.

3. The filter as recited in claim 2, wherein said filter is formed of a cellulose or cotton material.

4. The filter as recited in claim 3, wherein said color change indicator strip comprises a combination of at least two dyes wherein at least one of the dyes is substantive to the filter material while at least one of the dyes remains soluble in water, whereby exposure of the wick filter to water over a prolonged period of time causes dissolution or diffusion of one dye element thereby causing a color change in said indicator strip.

5. The filter as recited in claim 4, wherein said dyes have differential substantiveness to the filter material, one dye being substantive to the filter material and the other dye remaining slightly soluble in water.

6. The filter as recited in claim 5, wherein a first substantive dye includes Direct Red dye, and a second slightly water soluble non-substantive dye includes Acid Blue dye.

7. The filter as recited in claim 6, wherein the dyes are Acid Blue 83 (C.I. 42660) and Direct Red 23 (C.I. 29160).

8. The filter as recited in claim 7, wherein said filter further includes a permeable support structure on an outer surface of said filter and is integral with the filter structure, said filter and permeable support structure forming a cylindrical shape in which the permeable support is on an outer surface of said cylinder.

9. The filter as recited in claim 8, wherein said support comprises an expanded support frame bonded to said outer cylindrical surface of the wick filter and whereby the filter comprising a filter made of an expanded material.

10. The filter as recited in claim 9, wherein said support frame is formed of aluminum.

11. A filter for use with an evaporative humidifier comprising: a wick filter structure made of a water absorbing material with a permeable support structure on an outer surface of said wick filter which is integral with the wick filter structure, the wick filter and permeable support structure forming a cylindrical shape in which the permeable support is on an outer surface of said cylinder, wherein, said support comprises an expandable mesh support frame bonded to said outer cylindrical surface of the wick filter, said support frame is formed of aluminum, said wick filter material is formed of an expanded cotton or cellulose, and said wick filter further includes a color change indicator disposed on a surface thereof for providing indication when said wick filter should be replaced.

12. The evaporative humidifier as recited in claim 11 wherein, said color change indicator comprises a combination of at least two dyes wherein at least one of the dyes is substantive to the filter material while at least one of the dyes remains soluble in water, whereby exposure of the wick filter to water over a prolonged period of time causes dissolution or diffusion of one dye element thereby causing a color change in said indicator strip.

13. The filter, as recited in claim 11, wherein said wick filter material includes an algicide.

14. A evaporative humidifier comprising:

a. a base including a portion defining a reservoir for holding water, b. a housing mounted on said base over said reservoir said housing having an air inlet and an air outlet, c. a cylindrically shaped wick filter seated in said reservoir and extending into said housing, said cylindrically shaped wick filter having an open end and a sidewall, and d. a fan inside said housing for drawing air into said housing through said air inlet then into said cylindrically shaped wick filter through said open end, then out through said sidewall of said cylindrically shaped wick filter and then out of said housing through said air outlet, wherein said wick filter further includes a color change indicator disposed on said wick filter for providing indication when said wick filter should be replaced.

15. The evaporative humidifier as recited in claim 14 wherein said wick filter further includes an inner cylindrically shaped sidewall, the inner surface of said sidewall including said color change indicator.

16. The evaporative humidifier as recited in claim 15, wherein said color change indicator is in the form of a painted strip on said inner surface.

17. The evaporative humidifier as recited in claim 16, wherein said wick filter is formed of a cellulose or cotton material.

18. The evaporative humidifier as recited in claim 17, wherein said color change indicator strip comprises a combination of at least two dyes wherein at least one of the dyes is substantive to cellulose while at least one of the dyes remains soluble in water whereby exposure of the wick filter to water over a prolonged period of time causes dissolution or diffusion of one dye element thereby causing a color change in said indicator strip.

19. The evaporative humidifier as recited in claim 18, wherein said dyes have differential substantiveness to cellulose, one being substantive to the cellulose and the other remaining slightly soluble in water.

20. The evaporative humidifier as recited in claim 19, wherein a first cellulose substantive dye includes Direct Red dye, and a second slightly water soluble non-substantive to cellulose dye includes Acid Blue dye.

21. The evaporative humidifier as recited in claim 20, wherein the dyes are Acid Blue 83 (C.I. 42660) and Direct Red 23 (C.I. 29160).

22. An evaporative humidifier comprising:

a. a base including a portion defining a reservoir for holding water, b. a housing mounted on said base over said reservoir, said housing including a cylindrically shaped sidewall having an air inlet and an air outlet, c. a cylindrically shaped wick filter seated in said reservoir and extending into said housing, said cylindrically shaped wick filter having an open end an a sidewall, d. a permeable support structure formed on an outer surface of said wick filter and which is integral with the wick filter, e. a fan inside said housing for drawing air into said housing through said air inlet then into the area inside the sidewall of said cylindrically shaped wick filter through said open end, then out through said sidewall of said cylindrically shaped wick filter and then out of said housing through said air outlet, f. a deflector for deflecting the air drawn in down into said cylindrically shaped wick filter, and g. a pair of removable water supply tanks positioned adjacent opposite sides of the humidifier housing and having curved recesses which conform to the curvature of the cylindrically shaped sidewall of the housing.

23. An evaporative humidifier comprising:

a. a base including a portion defining a reservoir for holding water, b. a housing mounted on said base over said reservoir, said housing including a cylindrically shaped sidewall having an air inlet and an air outlet, c. a cylindrically shaped wick filter seated in said reservoir and extending into said housing, said cylindrically shaped wick filter having an open end an a sidewall, d. a permeable support structure formed an outer surface of said wick filter and which is integral with the wick filter, e. a color change indicator disposed on said wick for providing indication when said wick filter should be replaced, f. a fan inside said housing for drawing air into said housing through said air inlet then into the area inside the sidewall of said cylindrically shaped wick filter through said open end, then out through said sidewall of said cylindrically shaped wick filter and then out of said housing through said air outlet, g. a deflector for deflecting the air drawn in down into said cylindrically shaped wick filter, and h. a pair of removable water supply tanks positioned adjacent opposite sides of the humidifier housing and having curved recesses which conform to the curvature of the cylindrically shaped sidewall of the housing.

* * * * *